US010975587B2

(12) United States Patent
Nelson

(10) Patent No.: US 10,975,587 B2
(45) Date of Patent: Apr. 13, 2021

(54) SYSTEM FOR FORMING SWIMMING POOL RADIUS SUPPORTS

(71) Applicant: Hydra Pools, Inc., Sweetwater, TN (US)

(72) Inventor: Laurence A. Nelson, Knoxville, TN (US)

(73) Assignee: Hydra Pools, Inc., Sweetwater, TN (US)

( * ) Notice: Subject to any disclaimer, the term of this patent is extended or adjusted under 35 U.S.C. 154(b) by 14 days.

(21) Appl. No.: 16/390,148

(22) Filed: Apr. 22, 2019

(65) Prior Publication Data

US 2020/0332545 A1 Oct. 22, 2020

(51) Int. Cl.
*E04H 4/14* (2006.01)
*E04H 4/00* (2006.01)

(52) U.S. Cl.
CPC ..... *E04H 4/14* (2013.01); *E04H 4/0043* (2013.01)

(58) Field of Classification Search
CPC ..... E04H 4/14
USPC ..... 4/506, 488; 52/741.1, 169.7; 482/55
See application file for complete search history.

(56) References Cited

U.S. PATENT DOCUMENTS 1,545,402 A 7/1925 Coyne
2,205,859 A 6/1940 O'Donnell
2,495,037 A 1/1950 Tinnerman
2,716,434 A 8/1955 Crowther
3,236,012 A 2/1966 Laven
3,374,491 A 3/1968 Patin et al.
3,413,886 A 12/1968 Proctor
3,421,563 A 1/1969 Koss
3,478,370 A 11/1969 Stern et al.
3,978,628 A 9/1976 Turner
4,015,650 A 4/1977 Anderson
4,026,341 A 5/1977 Menke
4,193,435 A 3/1980 Charles et al.
4,270,591 A 6/1981 Gill et al.
4,343,120 A 8/1982 Witte
4,348,140 A 9/1982 Bergholz et al.
4,432,575 A 2/1984 Garvey et al.
4,464,090 A 8/1984 Duran
4,557,651 A 12/1985 Peterson
4,599,832 A 7/1986 Rinke
4,635,304 A * 1/1987 Zikmanis ..... E04H 4/0043 4/488
4,752,993 A 6/1988 Oaks
(Continued)

*Primary Examiner* — Lori L Baker
(74) *Attorney, Agent, or Firm* — Pitts & Lake, P.C.

(57) ABSTRACT

A modular structure to form a swimming pool radius, and a method of constructing the same, the structure including a wall panel having front and rear surfaces, side surface members extending back from each of the two side edges of the wall panel, top surface members extending back from the top edge of the wall panel, bottom surface members extending back from the bottom edge of the wall panel, upper flange members respectively extending downward from a distal end of each of the top surface members, lower flange members respectively extending upward from a distal end of each of the bottom surface members, a top support band coupled to each of the upper flange members, and a bottom support band coupled to each of the lower flange members, the top and bottom support bands configured to maintain the wall panel in a predetermined arcuate configuration.

19 Claims, 6 Drawing Sheets

(56) References Cited

U.S. PATENT DOCUMENTS

| | | | | |
|---|---|---|---|---|
| 4,815,908 | A | 3/1989 | Duran et al. | |
| 4,826,374 | A | 5/1989 | Baglin | |
| 4,895,484 | A | 1/1990 | Wilcox | |
| 4,911,591 | A | 3/1990 | Oaks | |
| 4,952,107 | A | 8/1990 | Dupree | |
| 5,066,180 | A | 11/1991 | Lang et al. | |
| 5,086,595 | A | 2/1992 | Maiuccoro et al. | |
| 5,107,640 | A | 4/1992 | Gefroh et al. | |
| 5,186,874 | A | 2/1993 | McLaughlin | |
| 5,193,868 | A | 3/1993 | O'Toole | |
| 5,652,972 | A * | 8/1997 | Chartrand | E04H 4/0043 4/506 |
| 5,752,350 | A | 5/1998 | Maiuccoro | |
| 5,941,030 | A | 8/1999 | Williamson | |
| 6,260,313 | B1 | 7/2001 | Stegmeier | |
| 6,408,577 | B1 | 6/2002 | Desjoyaux et al. | |
| 6,655,098 | B2 | 12/2003 | Dillen, II et al. | |
| 6,811,363 | B1 | 11/2004 | Minnich | |
| 7,073,995 | B2 | 7/2006 | Herb | |
| 7,086,817 | B2 | 8/2006 | Clinch et al. | |
| 7,134,821 | B2 | 11/2006 | Clinch et al. | |
| 7,192,231 | B2 | 3/2007 | Blackaby | |
| 7,237,314 | B2 | 7/2007 | Toosky | |
| 7,246,978 | B2 | 7/2007 | Morishima et al. | |
| 7,255,521 | B2 | 8/2007 | Yake et al. | |
| 7,309,200 | B2 | 12/2007 | Schmieder et al. | |
| 7,784,227 | B2 * | 8/2010 | Ribeiro | E04H 4/0043 4/506 |
| 7,802,324 | B2 * | 9/2010 | Layfield | A47K 3/00 4/541.1 |
| 7,802,952 | B2 | 9/2010 | Toosky et al. | |
| 8,112,951 | B2 | 2/2012 | Gravel | |
| 8,499,507 | B1 | 8/2013 | Saccoccio et al. | |
| 8,661,749 | B2 | 3/2014 | Gibson | |
| 8,701,265 | B1 | 4/2014 | James | |
| 8,821,091 | B2 | 9/2014 | Sato et al. | |
| 8,857,115 | B2 | 10/2014 | Epple | |
| 8,919,055 | B2 | 12/2014 | Nelson | |
| 8,936,134 | B2 | 1/2015 | Lipniarski | |
| 8,950,155 | B2 | 2/2015 | Maiuccoro | |
| 8,985,924 | B2 | 3/2015 | Nakamura et al. | |
| 9,194,147 | B2 * | 11/2015 | Campodonico | E04H 4/0031 |
| 9,404,274 | B2 * | 8/2016 | Maiuccoro | E04H 4/144 |
| 2014/0173820 | A1 * | 6/2014 | Campodonico | E04H 4/0031 4/506 |

* cited by examiner

SYSTEM FOR FORMING SWIMMING POOL RADIUS SUPPORTS

CROSS-REFERENCE TO RELATED APPLICATIONS

Not applicable.

FIELD OF INVENTION

The present general inventive concept relates to a swimming pool radius panel, and, more particularly, to a swimming pool radius panel for which reinforcement ribs may be more conveniently formed.

BACKGROUND

Forming walls for in below-the-ground swimming pools may typically involve the use of prefabricated modular walls that may be joined together on site. Some of these prefabricated walls are formed with panels that are designed to be made into either concave or convex panels that are held in shape by reinforcing members attached to the base panel. Thus, it is desirable to provide such a panel that has a more efficient construction to aid in maintaining the proper shape of the panel.

BRIEF SUMMARY

According to various example embodiments of the present general inventive concept, a modular wall structure to form a swimming pool radius is provided with flanges having support bands connected thereto to maintain the structure in a predetermined arcuate configuration, the support bands extending continuously and substantially from end to end of the structure such that support ribs may be conveniently located after the application of the support bands.

Additional aspects and advantages of the present general inventive concept will be set forth in part in the description which follows, and, in part, will be obvious from the description, or may be learned by practice of the present general inventive concept.

The foregoing and/or other aspects and advantages of the present general inventive concept may be achieved by providing a modular wall structure to form a swimming pool radius, the wall structure including a wall panel having a front surface and rear surface defined by a top edge, a bottom edge, and two side edges, at least one side surface member extending back from each of the two side edges of the wall panel, a plurality of top surface members extending back from the top edge of the wall panel, a plurality of bottom surface members extending back from the bottom edge of the wall panel, a plurality of upper flange members respectively extending downward from a distal end of each of the top surface members, a plurality of lower flange members respectively extending upward from a distal end of each of the bottom surface members, a top support band coupled to each of the upper flange members, and a bottom support band coupled to each of the lower flange members, wherein the top and bottom support bands are configured to maintain the wall panel in a predetermined arcuate configuration.

The foregoing and/or other aspects and advantages of the present general inventive concept may also be achieved by providing a method of manufacturing a modular wall structure used to form a swimming pool radius, the method including forming, from a substantially flat metal body, a wall panel having a front surface and rear surface defined by a top edge, a bottom edge, and two side edges, at least one side surface member extending back from each of the two side edges of the wall panel, a plurality of top surface members extending back from the top edge of the wall panel, a plurality of bottom surface members extending back from the bottom edge of the wall panel, a plurality of upper flange members respectively extending downward from a distal end of each of the top surface members, and a plurality of lower flange members respectively extending upward from a distal end of each of the bottom surface members, bending the wall panel to a predetermined arcuate configuration, connecting a top support band to each of the upper flange members, and connecting a bottom support band to each of the lower flange members, wherein the top and bottom support bands maintain the wall panel in the predetermined arcuate configuration.

Other features and aspects may be apparent from the following detailed description, the drawings, and the claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

According to various example embodiments of the present general inventive concept, a modular wall structure to form a swimming pool radius is provided with flanges having support bands connected thereto to maintain the structure in a predetermined arcuate configuration, the support bands extending continuously and substantially from end to end of the structure such that support ribs may be conveniently located after the application of the support bands. With such support bands extending essentially from end to end of the wall structure, support ribs may be easily added at desired positions along the length of the support bands, providing an improved structure with a more convenient construction than with the related art, which typically applies a plurality of the support bands around rib locations.

Figure 1A:
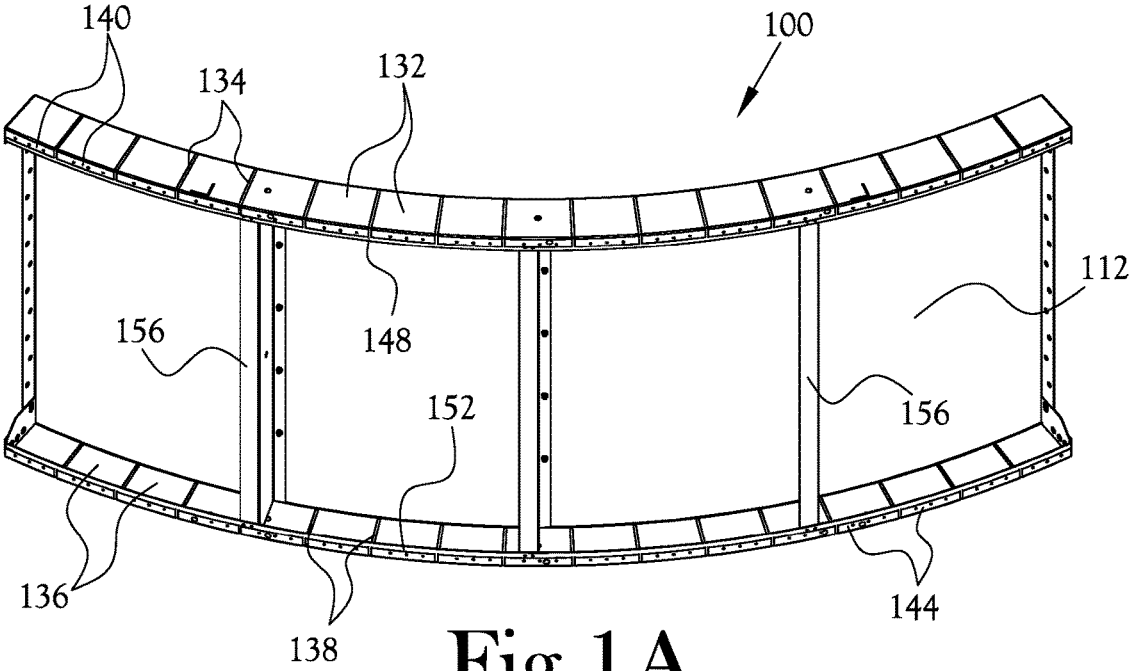
FIGS. 1A-1B illustrate a modular wall structure used to form a swimming pool radius according to an example embodiment of the present general inventive concept.
Figure 1B:
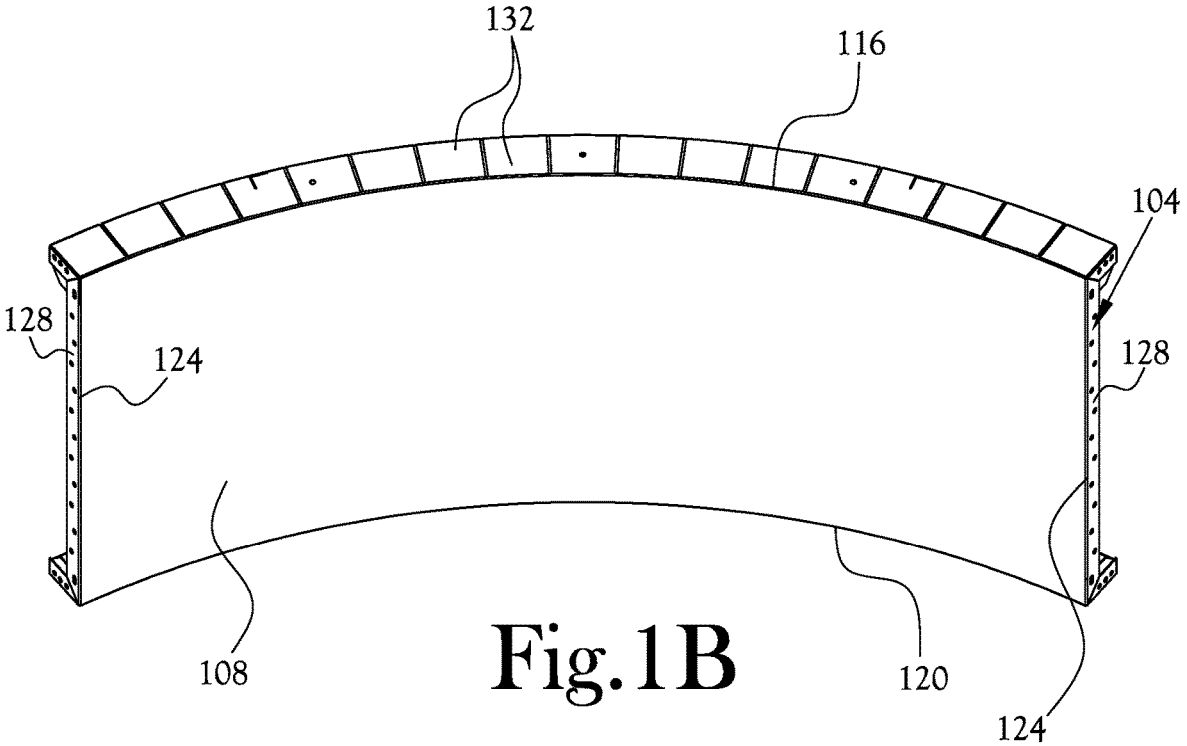
Figure 2:
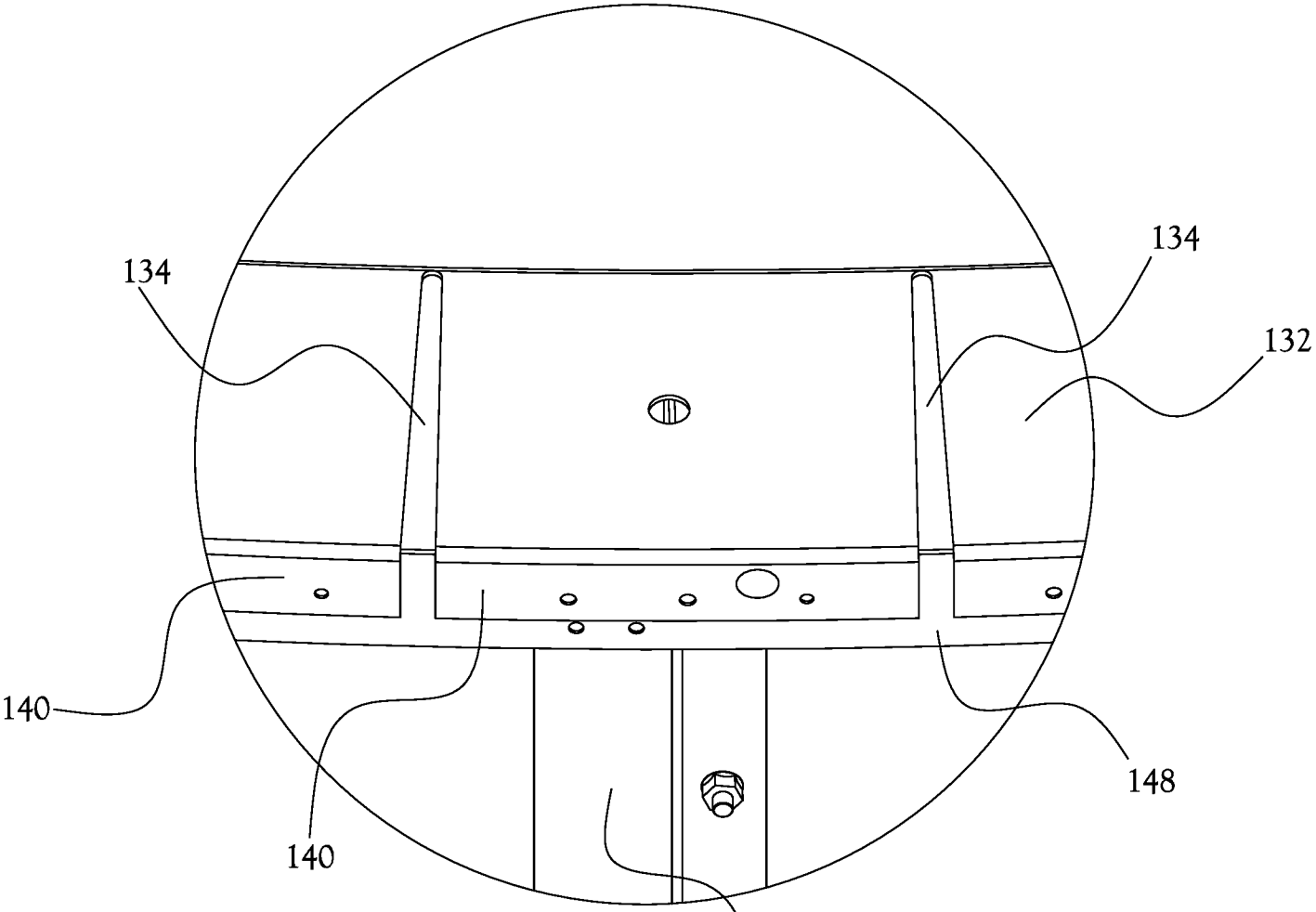
FIG. 2 illustrates a blown-up view of a portion of the example embodiment illustrated in FIG. 1A.

FIGS. 1A-1B illustrate a modular wall structure used to form a swimming pool radius according to an example embodiment of the present general inventive concept, and FIG. 2 illustrates a blown-up view of a portion of the example embodiment illustrated in FIG. 1A. As illustrated in FIGS. 1A-2, this example embodiment of a modular wall structure 100 includes a wall panel 104 having a front surface 108 and rear surface 112 defined by an upper edge 116, a lower edge 120, and two opposed side edges 124. Side surfaces 128 extend back from each side edge 124 of the panel 104, and may be provided with a plurality of apertures that may be used to connect the modular wall structure 100 to other similarly formed wall structures. A top surface of the wall structure 100 is formed with a plurality of top surface members 132 that extend back from the upper edge 116 of the panel 104, and these top surface members 132 are formed with gaps 134 in between to prevent the top surface members 132 from contacting/hindering one another when the panel 104 is bent to a desired curve needed to form a section of a swimming pool wall. The top surface members 132 of this example embodiment are tapered such that the distal ends thereof are narrower than the end located at the upper edge 116 of the panel 104. Such a tapered configuration allows more room between the distal ends of the top surface members 132, so that an outwardly curved panel 104 can have an increased radius without any adjacent top surface members 132 contacting one another. Similarly, a plurality of bottom surface members 136 extend back from the lower edge 120 of the panel 104, and formed with gaps 138 in between to prevent the bottom surface members 136 from contacting/hindering one another when the panel 104 is curved. The bottom surface members 136 are formed with the same tapered configuration as the top surface members 132. A plurality of upper flange members 140 respectively extend downward from each of the distal ends of the top surface members 132, and a plurality of lower flange members 144 respectively extend upward from each of the distal ends of the bottom surface members 136. The upper and lower flange members 140,144 are used to maintain a desired curve of the panel by connecting a top support band 148 to each of the upper flange members 140, and a bottom support band 152 to each of the lower flange members. By fixing the support bands 148,152 to the flange members 140,144, the desired curve to which the panel is bent will be maintained. The support bands 148,152 extend in a continuous fashion substantially between the side edges 124 of the panel. One or more support ribs 156 are provided to give structural support to the panel 104. An outer portion of the support ribs 156 are attached at either end of the ribs 156 to the top and bottom support bands 148,152, and an inner portion of the support band is attached to the rear surface 112 of the panel 104. In this example embodiment, the support ribs 156 are configured with an inner flat surface contacting the rear surface 112 of the panel 104, an outer flat surface contacting the top and bottom support bands 148,152, and a connecting portion extending between the inner and outer flat surfaces. As illustrated, the top and bottom support bands 148,152 are connected to the inner surfaces of the upper and lower flange members. However, various example embodiments may provide a wall structure in which the support bands are connected to the outer surfaces of the flange members, or are connected directly to the lower edges thereof to maintain the desired arcuate configuration of the panel. It is understood that various example embodiments of the present general inventive concept may be provided with more or less components, and which may be differently configured, without departing from the scope of the present general inventive concept. In various example embodiments, the wall panel, side surface members, top surface members, bottom surface members, upper flange members, and lower flange members may be continuously formed, e.g., all formed from the same sheet of flat metal. In still other example embodiments, one or more of these components may formed from a different sheet of metal or other material and attached to one or more of the other components.

Figure 3:
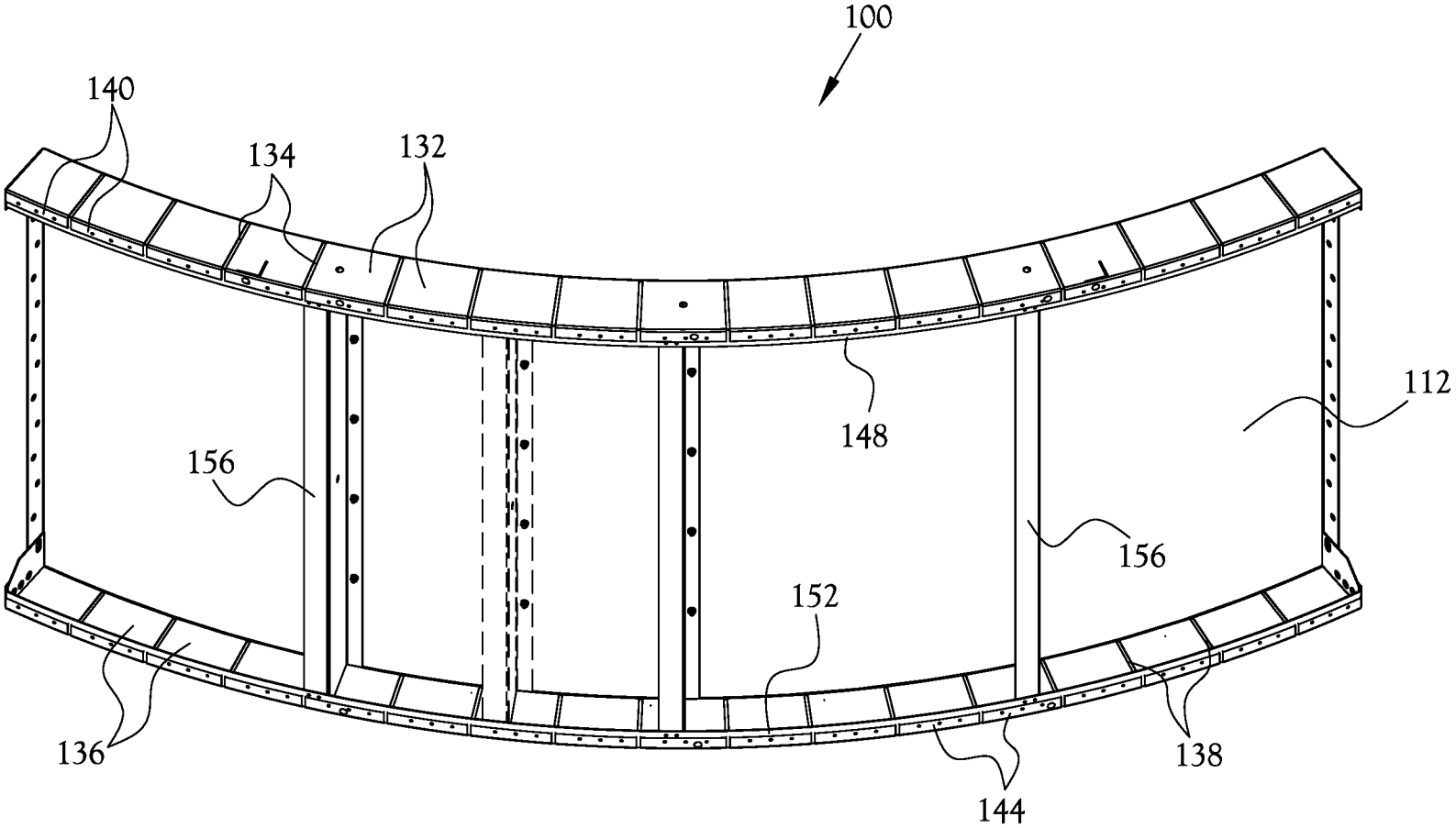
FIG. 3 illustrates an alternative configuration of the example embodiment illustrated in FIG. 1A.

FIG. 3 illustrates an alternative configuration of the example embodiment illustrated in FIG. 1A. As illustrated in FIG. 3, because the support ribs 156 may be placed at any point along the support bands 148,152, additional ribs 156 may be added at any desired point along the panel 104, and may even be added at a time later than the construction of the rest of the structure 100, due to the support bands 148,152 being continuously formed along the span of the structure 100.

Figure 4:
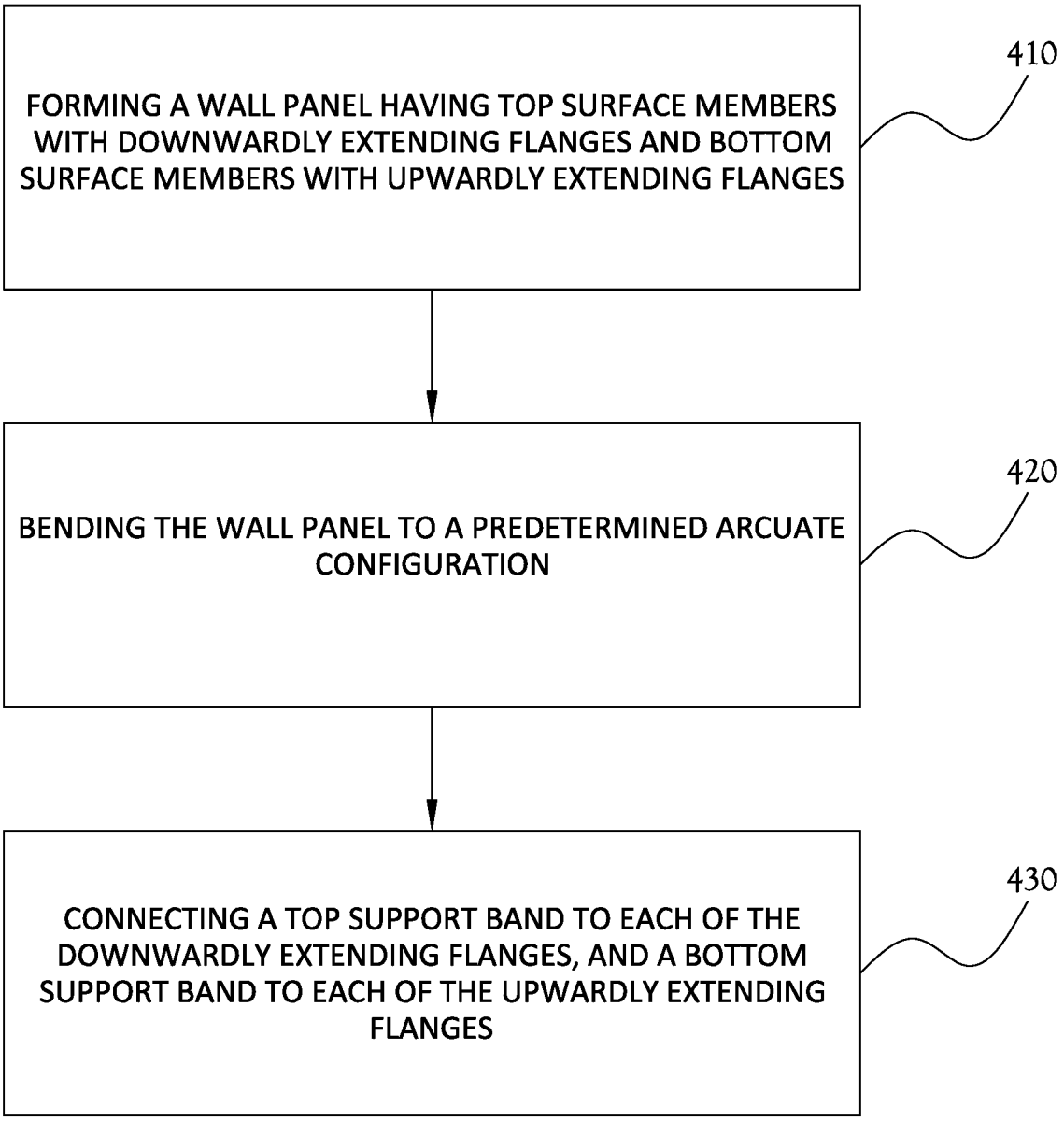
FIG. 4 is a flow chart illustrating a method of constructing a modular wall structure for a swimming pool according to an example embodiment of the present general inventive concept.

FIG. 4 is a flow chart illustrating a method of constructing a modular wall structure for a swimming pool according to an example embodiment of the present general inventive concept. It is noted that various example embodiments of the present general inventive concept may include different operations that may be completed in different orders than that illustrated in this example embodiment. As illustrated in FIG. 4, in operation 410 a wall panel is formed that has top surface members extending back from a top edge of the wall panel and having downwardly extending flanges, and bottom surface members extending back from a bottom edge of the wall panel and having upwardly extending flanges. As previously described, the wall panel, top and bottom surface members, and flanges may all be formed continuously from one sheet of metal. In operation 420 the wall panel is bent to a predetermined curve that is needed at a particular part of the swimming pool at which this wall structure will be located. In operation 430 a top support band is connected to each of the downwardly extending flanges, and a bottom support band is connect to each of the upwardly extending flanges, and these support bands maintain the predetermined arcuate configuration of the wall structure. The top and bottom support bands extend continuously to connect to all of the respective top and bottom flanges. Thus, in an example embodiment, a manufacturer may form, from one substantially flat metal body, the previously described wall panel having the side surface members, top surface members with top flanges, and bottom surface members with bottom flanges, and then bend the panel to a desired curve and maintain the panel in that configuration by attaching the respective support bands to the flanges. Due to the gaps between the top and bottom surface members, the panel may be curved to a concave or convex configuration without interference between the respective top and bottom surface members.

Figure 5:
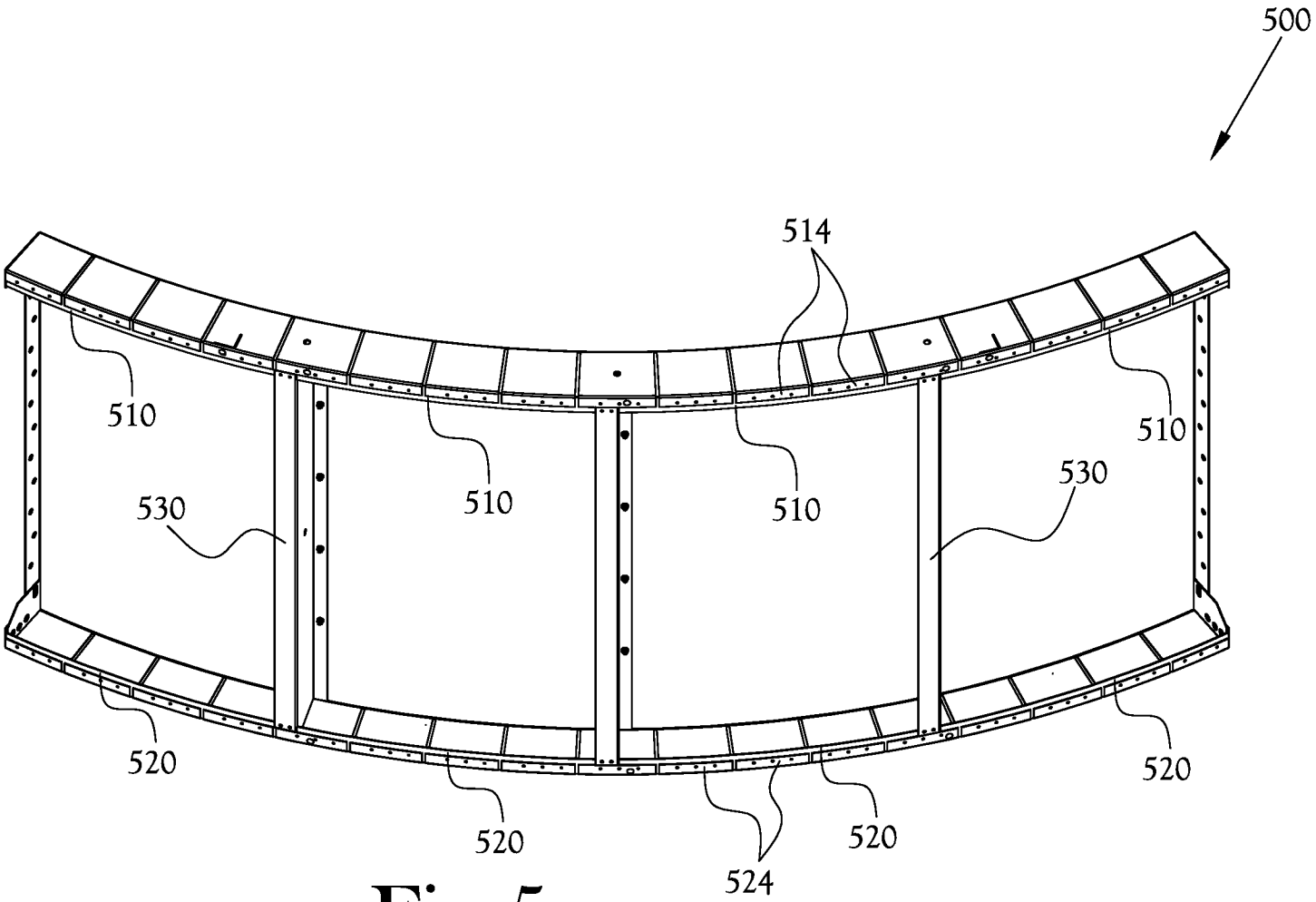
Fig.5 (RELATED ART)
FIG. 5 illustrates a swimming pool modular wall structure according to the related art.
Figure 6:
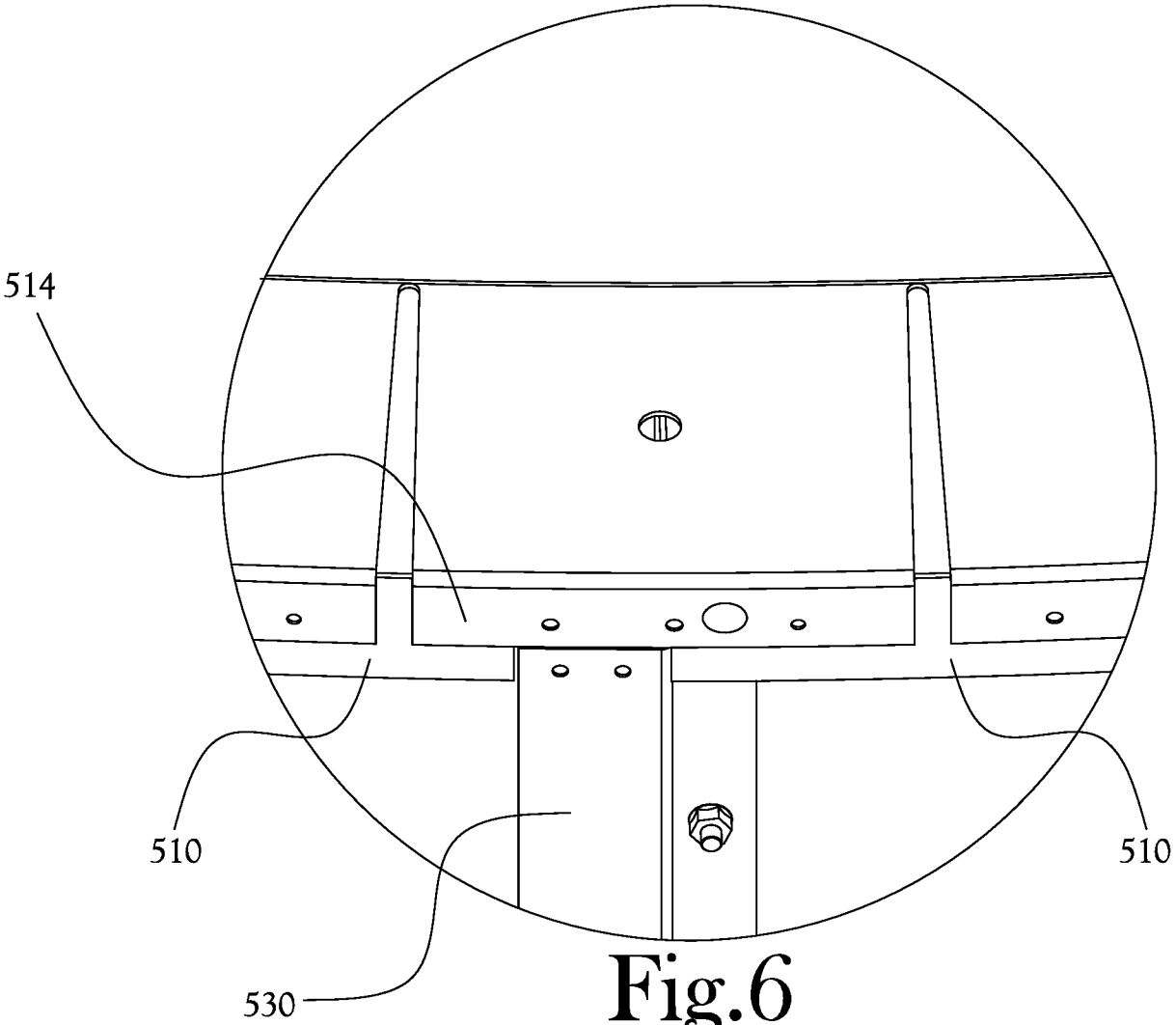
Fig.6 (RELATED ART)
FIG. 6 illustrates a blown-up view of a portion of the wall structure illustrated in FIG. 5.

FIG. 5 illustrates a swimming pool modular wall structure according to the related art, and FIG. 6 illustrates a blown-up view of a portion of the wall structure illustrated in FIG. 5. As illustrated in FIGS. 5-6, a conventional wall structure 500 is formed with a plurality of top support bands 510 each being connected to some of the adjacent top surface members 514, and a corresponding plurality of bottom support bands 520 each being connected to some of the adjacent bottom surface members 524. The top and bottom support bands 510,520 are discontinuous and placed on either side of each of the ribs 530. Thus, the ribs 530 are typically installed to the wall structure, and then the support bands 510,520 are connected to maintain the curve of the structure. This results in a more complicated construction, and also makes it much more problematic to add ribs 530 at additional locations, and/or at later times. Thus, the present general inventive concept provides an improved structure and method of construction over the conventional art.

Various example embodiments of the present general inventive concept may provide a modular wall structure to form a swimming pool radius, the wall structure including a wall panel having a front surface and rear surface defined by a top edge, a bottom edge, and two side edges, at least one side surface member extending back from each of the two side edges of the wall panel, a plurality of top surface members extending back from the top edge of the wall panel, a plurality of bottom surface members extending back from the bottom edge of the wall panel, a plurality of upper flange members respectively extending downward from a distal end of each of the top surface members, a plurality of lower flange members respectively extending upward from a distal end of each of the bottom surface members, a top support band coupled to each of the upper flange members, and a bottom support band coupled to each of the lower flange members, wherein the top and bottom support bands are configured to maintain the wall panel in a predetermined arcuate configuration. The modular wall structure may further include at least one support rib member coupled at an outer portion thereof to the top and bottom support bands, and coupled at an inner portion thereof to the rear surface of the wall panel. The at least one support rib member may include an inner flat member configured to contact the rear surface of the wall panel, an outer flat member configured to contact the top and bottom support band, and a connecting portion extending between the inner and outer flat members. The top and bottom support bands may be respectively coupled to inward facing surfaces of the upper and lower flange members. Gaps may be formed between any adjacent top surface members and between any adjacent bottom surface members such that the panel may be curved to a concave or convex shape without contact between adjacent top surface members or adjacent bottom surface members. The top surface members and bottom surface members may be tapered so as to be narrower at the distal ends thereof. The wall panel, side surface members, top surface members, bottom surface members, upper flange members, and lower flange members may be continuously formed.

Various example embodiments of the present general inventive concept may provide a method of manufacturing a modular wall structure used to form a swimming pool radius, the method including forming, from a substantially flat metal body, a wall panel having a front surface and rear surface defined by a top edge, a bottom edge, and two side edges, at least one side surface member extending back from each of the two side edges of the wall panel, a plurality of top surface members extending back from the top edge of the wall panel, a plurality of bottom surface members extending back from the bottom edge of the wall panel, a plurality of upper flange members respectively extending downward from a distal end of each of the top surface members, and a plurality of lower flange members respectively extending upward from a distal end of each of the bottom surface members, bending the wall panel to a predetermined arcuate configuration, connecting a top support band to each of the upper flange members, and connecting a bottom support band to each of the lower flange members, wherein the top and bottom support bands maintain the wall panel in the predetermined arcuate configuration. The predetermined arcuate configuration may be concave or convex. The method may further include attaching at least one support rib member, at an outer portion thereof, to the top and bottom support bands, and, at an inner portion thereof, to the rear surface of the wall panel. The at least one support rib member may include an inner flat member configured to contact the rear surface of the wall panel, an outer flat member configured to contact the top and bottom support band, and a connecting portion extending between the inner and outer flat members. The method may further include connecting the top and bottom support bands to inward facing surfaces of the upper and lower flange members. The method may further include forming gaps between any adjacent top surface members and between any adjacent bottom surface members such that the panel may be curved to a concave or convex shape without contact between adjacent top surface members or adjacent bottom surface members. The method may further include tapering the top surface members and bottom surface members so as to be narrower at the distal ends thereof. The method may further include forming the wall panel, side surface members, top surface members, bottom surface members, upper flange members, and lower flange members from a continuous sheet of metal. The top and bottom support bands may extend continuously and substantially between the side edges.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein, using sound engineering judgment. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. A modular wall structure to form a swimming pool radius, the wall structure comprising:

a wall panel having a front surface and rear surface defined by a top edge, a bottom edge, and two side edges;

at least one side surface member extending back from each of the two side edges of the wall panel;

a plurality of top surface members extending back from the top edge of the wall panel;

a plurality of bottom surface members extending back from the bottom edge of the wall panel;

a plurality of upper flange members respectively extending downward from a distal end of each of the top surface members;

a plurality of lower flange members respectively extending upward from a distal end of each of the bottom surface members;

a top support band coupled to each of the upper flange members; and a bottom support band coupled to each of the lower flange members;

wherein the top and bottom support bands are configured to maintain the wall panel in a predetermined arcuate configuration, and wherein the wall panel, side surface members, top surface members, bottom surface members, upper flange members, and lower flange members are continuously formed.

2. The modular wall structure of claim 1, further comprising at least one support rib member coupled at an outer portion thereof to the top and bottom support bands, and coupled at an inner portion thereof to the rear surface of the wall panel.

3. The modular wall structure of claim 2, wherein the at least one support rib member comprises:

an inner flat member configured to contact the rear surface of the wall panel;

an outer flat member configured to contact the top and bottom support band; and a connecting portion extending between the inner and outer flat members.

4. The modular wall structure of claim 1, wherein the top and bottom support bands are respectively coupled to inward facing surfaces of the upper and lower flange members.

5. The modular wall structure of claim 1, wherein gaps are formed between any adjacent top surface members and between any adjacent bottom surface members such that the panel may be curved to a concave or convex shape without contact between adjacent top surface members or adjacent bottom surface members.

6. The modular wall structure of claim 1, wherein the top surface members and bottom surface members are tapered so as to be narrower at the distal ends thereof.

7. A method of manufacturing a modular wall structure used to form a swimming pool radius, the method comprising:

forming, from a substantially flat metal body:

a wall panel having a front surface and rear surface defined by a top edge, a bottom edge, and two side edges, at least one side surface member extending back from each of the two side edges of the wall panel, a plurality of top surface members extending back from the top edge of the wall panel, a plurality of bottom surface members extending back from the bottom edge of the wall panel, a plurality of upper flange members respectively extending downward from a distal end of each of the top surface members, and a plurality of lower flange members respectively extending upward from a distal end of each of the bottom surface members;

bending the wall panel to a predetermined arcuate configuration;

connecting a top support band to each of the upper flange members; and connecting a bottom support band to each of the lower flange members;

wherein the top and bottom support bands maintain the wall panel in the predetermined arcuate configuration.

8. The method of claim 7, wherein the predetermined arcuate configuration is concave or convex.

9. The method of claim 7, further comprising attaching at least one support rib member, at an outer portion thereof, to the top and bottom support bands, and, at an inner portion thereof, to the rear surface of the wall panel.

10. The method of claim 9, wherein the at least one support rib member comprises:

an inner flat member configured to contact the rear surface of the wall panel;

an outer flat member configured to contact the top and bottom support band; and a connecting portion extending between the inner and outer flat members.

11. The method of claim 7, further comprising connecting the top and bottom support bands to inward facing surfaces of the upper and lower flange members.

12. The method of claim 7, further comprising forming gaps between any adjacent top surface members and between any adjacent bottom surface members such that the panel may be curved to a concave or convex shape without contact between adjacent top surface members or adjacent bottom surface members.

13. The method of claim 7, further comprising tapering the top surface members and bottom surface members so as to be narrower at the distal ends thereof.

14. The method of claim 7, further comprising forming the wall panel, side surface members, top surface members, bottom surface members, upper flange members, and lower flange members from a continuous sheet of metal.

15. The method of claim 7, wherein the top and bottom support bands extend continuously and substantially between the side edges.

16. A modular wall structure to form a swimming pool radius, the wall structure comprising:

a wall panel having a front surface and rear surface defined by a top edge, a bottom edge, and two side edges;

at least one side surface member extending back from each of the two side edges of the wall panel;

a plurality of top surface members extending back from the top edge of the wall panel;

a plurality of bottom surface members extending back from the bottom edge of the wall panel;

a plurality of upper flange members respectively extending downward from a distal end of each of the top surface members;

a plurality of lower flange members respectively extending upward from a distal end of each of the bottom surface members;

a top support band coupled to each of the upper flange members;

a bottom support band coupled to each of the lower flange members; and at least one support rib member coupled at an outer portion thereof to the top and bottom support bands, and coupled at an inner portion thereof to the rear surface of the wall panel, the at least one support rib member comprising:

an inner flat member configured to contact the rear surface of the wall panel, an outer flat member configured to contact the top and bottom support band, and a connecting portion extending between the inner and outer flat members;

wherein the top and bottom support bands are configured to maintain the wall panel in a predetermined arcuate configuration.

17. A modular wall structure to form a swimming pool radius, the wall structure comprising:

a wall panel having a front surface and rear surface defined by a top edge, a bottom edge, and two side edges;

at least one side surface member extending back from each of the two side edges of the wall panel;

a plurality of top surface members extending back from the top edge of the wall panel;

a plurality of bottom surface members extending back from the bottom edge of the wall panel;

a plurality of upper flange members respectively extending downward from a distal end of each of the top surface members;

a plurality of lower flange members respectively extending upward from a distal end of each of the bottom surface members;

a top support band coupled to each of the upper flange members; and a bottom support band coupled to each of the lower flange members;

wherein the top and bottom support bands are configured to maintain the wall panel in a predetermined arcuate configuration, and wherein the top and bottom support bands are respectively coupled to inward facing surfaces of the upper and lower flange members.

18. A modular wall structure to form a swimming pool radius, the wall structure comprising:

a wall panel having a front surface and rear surface defined by a top edge, a bottom edge, and two side edges;

at least one side surface member extending back from each of the two side edges of the wall panel;

a plurality of top surface members extending back from the top edge of the wall panel;

a plurality of bottom surface members extending back from the bottom edge of the wall panel;

a plurality of upper flange members respectively extending downward from a distal end of each of the top surface members;

a plurality of lower flange members respectively extending upward from a distal end of each of the bottom surface members;

a top support band coupled to each of the upper flange members; and a bottom support band coupled to each of the lower flange members;

wherein the top and bottom support bands are configured to maintain the wall panel in a predetermined arcuate configuration, and wherein gaps are formed between any adjacent top surface members and between any adjacent bottom surface members such that the panel may be curved to a concave or convex shape without contact between adjacent top surface members or adjacent bottom surface members.

19. A modular wall structure to form a swimming pool radius, the wall structure comprising:

a wall panel having a front surface and rear surface defined by a top edge, a bottom edge, and two side edges;

at least one side surface member extending back from each of the two side edges of the wall panel;

a plurality of top surface members extending back from the top edge of the wall panel;

a plurality of bottom surface members extending back from the bottom edge of the wall panel;

a plurality of upper flange members respectively extending downward from a distal end of each of the top surface members;

a plurality of lower flange members respectively extending upward from a distal end of each of the bottom surface members;

a top support band coupled to each of the upper flange members; and a bottom support band coupled to each of the lower flange members;

wherein the top and bottom support bands are configured to maintain the wall panel in a predetermined arcuate configuration, and wherein the top surface members and bottom surface members are tapered so as to be narrower at the distal ends thereof.

* * * * *